US009842552B2

(12) United States Patent
Han et al.

(10) Patent No.: US 9,842,552 B2
(45) Date of Patent: Dec. 12, 2017

(54) DATA DRIVING CIRCUIT, DISPLAY DEVICE AND DRIVING METHOD THEREOF

(71) Applicant: BOE Technology Group Co., Ltd., Beijing (CN)

(72) Inventors: Seung Woo Han, Beijing (CN); Yuanbo Zhang, Beijing (CN); Yoon Sung Um, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 191 days.

(21) Appl. No.: 14/423,006

(22) PCT Filed: May 28, 2014

(86) PCT No.: PCT/CN2014/078708
§ 371 (c)(1),
(2) Date: Feb. 20, 2015

(87) PCT Pub. No.: WO2015/109712
PCT Pub. Date: Jul. 30, 2015

(65) Prior Publication Data

US 2016/0042706 A1 Feb. 11, 2016

(30) Foreign Application Priority Data

Jan. 27, 2014 (CN) ..... 2014 1 0041066

(51) Int. Cl.
*G09G 3/36* (2006.01)
*G09G 3/20* (2006.01)

(52) U.S. Cl.
CPC ..... *G09G 3/3614* (2013.01); *G09G 3/20* (2013.01); *G09G 3/3685* (2013.01);
(Continued)

(58) Field of Classification Search
CPC .. G09G 3/3688; G09G 3/3648; G09G 3/3685; G09G 2310/0297;
(Continued)

(56) References Cited

U.S. PATENT DOCUMENTS 5,440,304 A 8/1995 Hirai
2006/0158408 A1* 7/2006 Hirose ..... G09G 3/3648 345/87
(Continued)

FOREIGN PATENT DOCUMENTS

CN 101071240 A 11/2007
CN 101510398 A * 8/2009
(Continued)

OTHER PUBLICATIONS

English Language Translation of CN 101510398 A; Published Aug. 19, 2009; Author: Mingzhang Lin et al.*
(Continued)

*Primary Examiner* — Nalini Mummalaneni
(74) *Attorney, Agent, or Firm* — Banner & Witcoff, Ltd.

(57) ABSTRACT

A data driving circuit comprises a plurality of driving units, each of the driving units comprising first, second, third and fourth switch units, each of the switch units comprising first and second input terminals and an output terminal; the output terminals being output terminals of the data driving circuit; two data control terminals, one of which is respectively connected to the first input terminals of the first switch unit and the second switch unit, the other of which is respectively connected to the first input terminals of the third switch unit and the fourth switch unit; a first switching control terminal, connected to the second input terminal of one of the switch units connected to the same data control terminal; a second switching control terminal, connected to
(Continued)

the second input terminal of the other of the switch units connected to the same data control terminal.

13 Claims, 4 Drawing Sheets

(52) U.S. Cl.
CPC ..... *G09G 2300/0408* (2013.01); *G09G 2310/0275* (2013.01); *G09G 2310/08* (2013.01); *G09G 2370/14* (2013.01)

(58) Field of Classification Search
CPC ..... G09G 2310/0224; G09G 2310/027; G09G 2300/0408
See application file for complete search history.

(56) References Cited

U.S. PATENT DOCUMENTS

| | | | | |
|---|---|---|---|---|
| 2007/0115231 | A1* | 5/2007 | Kumeta ..... | G09G 3/3614 345/88 |
| 2009/0189880 | A1 | 7/2009 | Li et al. | |

FOREIGN PATENT DOCUMENTS

| | | | |
|---|---|---|---|
| CN | 101777302 | A | 7/2010 |
| CN | 101826311 | A | 9/2010 |
| CN | 1975852 | B | 7/2012 |
| CN | 103093733 | A | 5/2013 |
| CN | 103778881 | A | 5/2014 |
| JP | 2003099008 | A | 4/2003 |
| TW | 200933583 | A | 8/2009 |

OTHER PUBLICATIONS

Nov. 13, 2014—English Translation of International Search Report and the Written Opinion Appn PCT/CN2014/078708.
Aug. 31, 2015—(CN)—First Office Action Appn 201410041066.5 with Eng Tran.
International Search Report and Written Opinion dated Nov. 13, 2014 (PCT/CN2014/078708); ISA/CN.
Jan. 18, 2016—(CN)—Second Office Action Appn 201410041066.5 with English Tran.

* cited by examiner

DATA DRIVING CIRCUIT, DISPLAY DEVICE AND DRIVING METHOD THEREOF

The application is a U.S. National Phase Entry of International Application No. PCT/CN2014/078708 filed on May 28, 2014, designating the United States of America and claiming priority to Chinese Patent Application No. 201410041066.5 filed on Jan. 27, 2014. The present application claims priority to and the benefit of the above-identified applications and the above-identified applications are incorporated by reference herein in their entirety.

TECHNICAL FIELD

Embodiments of the present invention relates to a data driving circuit, a display device and a driving method thereof.

BACKGROUND

FIG. 1 is a plan view of a pixel unit on an array substrate of TFS mode (a new ADS) and FIG. 2 is a simplified view of FIG. 1. As illustrated in FIGS. 1 and 2, gate lines and data lines on the array substrate are disposed to be intersected with each other, wherein one gate line (Sn) and two data lines (M1 and M2 or M3 and M4 in the figures), i.e. a configuration with one gate line and two data lines (1G2D), form a pixel subunit.

A driving method comprises that a data driving IC supplies data signals with equal electrical charges with opposite polarities to the two data lines of a pixel subunit, respectively, so as to drive pixel electrodes to display. As illustrated in FIG. 3, a data driving IC comprises a plurality of control terminals 10, each of which supplies data signals to respective data lines (M1, M2, M3, M4, . . . , Mn, Mn+1). Thus, a data driving IC comprises numerous control terminals, resulting in difficulties in miniaturizing a display device and a high device cost.

SUMMARY

Embodiments of the present disclosure provides a data driving circuit, a display device and a driving method, wherein the data driving circuit can reduce the number of control terminals of a driving IC correspondingly.

A data driving circuit, comprises a plurality of driving units, each of which comprises:

A first switch unit, a second switch unit, a third switch unit, a fourth switch unit; wherein each of the switch units comprises a first input terminal, and a second input terminal and a output terminal, respectively;

A first data control terminal and a second data control terminal, wherein the first data control terminal is connected to the first input terminals of the first switch unit and the second switch unit, respectively, and the second data control terminal is connected to the first input terminals of the third switch unit and the fourth switch unit, respectively;

A first switching control terminal, connected with one of switch units connected with the same data control terminal;

A second switching control terminal, connected with another of switch units connected with the same data control terminal;

The output terminals of the switch units are output terminals of the data driving circuit.

According to an embodiment of the present disclosure, the first switch unit, the second switch unit, the third switch unit and the fourth switch unit are thin film transistors.

According to an embodiment of the present disclosure, data signals output from the switch unit connected with the first switching control terminal and data signals output form the switch unit connected with the second switching control terminal have the same quantity of electrical charges with opposite polarity.

According to an embodiment of the present disclosure, the second switch unit and the third switch unit are disposed adjacent to each other, and both of the second switch unit and the third switch unit are connected to the first switching control terminal or the second switching control terminal.

According to an embodiment of the present disclosure, the second switch unit and the third switch unit are disposed adjacent to each other, and the second switch unit and the third switch unit are connected to the first switching control terminal and the second switching control terminal, respectively.

At least one embodiment of the present disclosure provide one display device, comprising an array substrate and any one of the data driving circuits according to embodiments of the present disclosure, a plurality of gate lines and a plurality of data lines intersecting with each other being disposed on the array substrate to define a plurality of pixel subunits, wherein one pixel subunit corresponds to one gate line and two data lines, four switch units of the data driving circuit are respectively connected to four data lines of two pixel units adjacent to each other on the array substrate, and output terminals of two switch units connected to the same data control terminal are respectively connected to two data lines of one pixel subunit on the array substrate so as to supply data signals to the data lines.

According to an embodiment of the present disclosure, the display device further comprises a timing controller which supplies polarity control signal for data signals to the data driving circuit.

Embodiments of the present disclosure provide a driving method for a display device, which comprising:

Supplying driving signals by a data control terminal to switch units connected with the data control terminal;

supplying an ON signal by a first switching control terminal to the switch unit connected with the first switching control terminal, so that an output terminal of the switch units supplies data signals to a data line connected with the output terminal; and supplying an ON signal by a second switching control terminal to the switch unit connected with the second switching control terminal, so that an output terminal of the switch units supplies data signals to a data line connected with the output terminal.

In an embodiment of the present disclosure, the ON signals supplied by the first switching control terminal and the ON signals supplied by the second switching control terminal have same quantity of electrical charges with opposite polarity, so that data signals output from the switch unit connected with the first switching control terminal and data signals output from the switch unit connected with the second switching control terminal have the same quantity of electrical charges with opposite polarities.

According to an embodiment of the present disclosure, a timing controller supplies polarity control signal for data signal to a data driving circuit.

Embodiments of the present disclosure provide a data driving circuit, a display device and a driving method therefor. One data control terminal of the data driving circuit is connected respectively to first input terminals of two switch units, a first switching control terminal is connected to a second input terminal of one switch unit, a second switching control terminal is connected to a second input terminal of another switch unit, so that one data control terminal can output two data signals by controlling the first switching control terminal and the second switching control terminal. Thus, the number of the data control terminals decreases, which enhances miniaturizing a data driving IC and reduces the cost.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

In order to make objects, technical details and advantages of the embodiments of the invention apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

At least one embodiment of the present disclosure provide a data driving circuit, which comprises a plurality of driving units, each of which comprises:

A first switch unit, a second switch unit, a third switch unit and a fourth switch unit, each of which comprising a first input terminal, a second input terminal and an output terminal;

A first data control terminal and a second data control terminal, wherein the first data control terminal is connected to first input terminals of the first switch unit and the second switch unit, respectively; the second data control terminal is connected to first input terminals of the third switch unit and the fourth switch unit, respectively;

A first switching control terminal, connected to a second input terminal of one of the switch units connected to the same data control terminal;

A second switching control terminal, connected to a second input terminal of the other of the switch units connected to the same data control terminal;

Output terminal of each of the switch units being an output terminal of the data driving circuit.

It should be noted that, the switch unit can be a switch which comprises a first input terminal, a second input terminal and an output terminal, and embodiments of the present disclosure are described by taking the switch unit being a thin film transistor as an example. The data driving circuit according to some embodiments of the present disclosure can be used as a data driving IC for an array substrate, and the output terminals of the driving circuit are connected to data lines of the array substrate, so as to supplies data signals to the data lines. The data driving circuit according to embodiments of the present disclosure comprises a plurality of driving units, each of which comprises a first switch unit, a second switch unit, a third switch unit and a fourth switch unit, and then each of the driving units comprises four output terminals, respectively supplying data signals to the data lines. For example, it is possible for two data lines connected to one data control terminal to respectively supply data signals to two data lines of one sub pixel.

Figure 1:
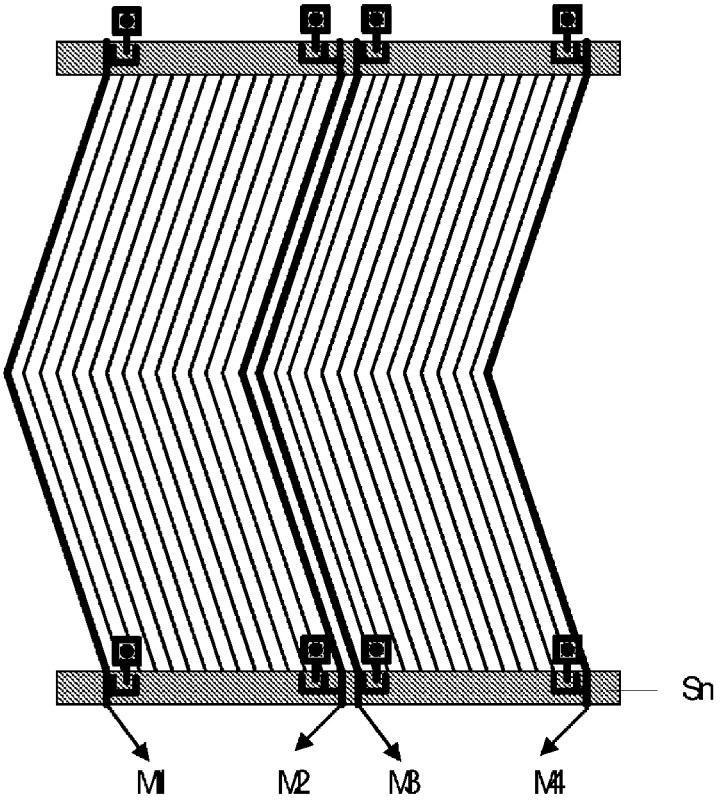
Fig. 1 (Prior Art)
FIG. 1 is a plan view of a pixel unit of an array substrate of TFS mode.
Figure 2:
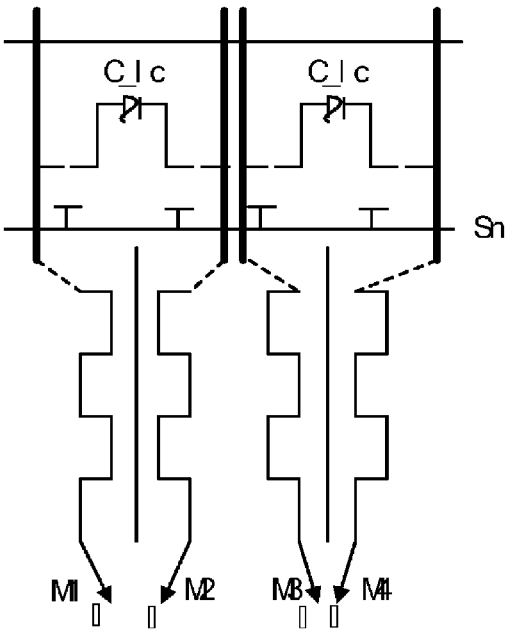
Fig. 2 (Prior Art)
FIG. 2 is a simplified view of the pixel unit illustrated in FIG. 1.
Figure 3:
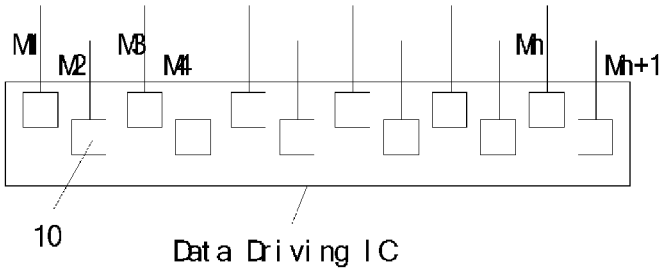
Fig. 3 (Prior Art)
FIG. 3 is a schematic view of a data driving IC of an array substrate of TFS mode.
Figure 4:
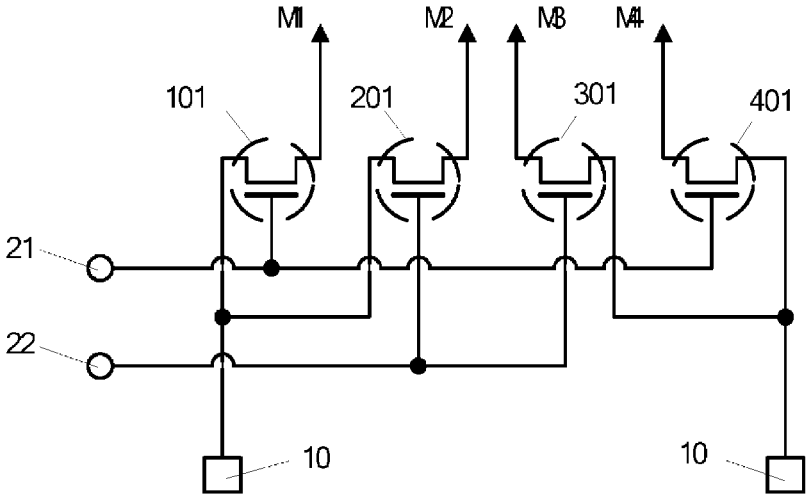
FIG. 4 is a schematic view of a data driving circuit according to an embodiment of the present disclosure.

As illustrated in FIG. 4, description is given by taking a data driving circuit correspondingly driving four data lines M1, M2, M3 and M4 as an example, connection manners of other data lines can be referred to the connection manner as illustrated in FIG. 4. The data driving circuit illustrated in FIG. 4 comprises two data control terminals 10, wherein one of the data control terminals 10 is respectively connected to a first input terminal of a first thin film transistor 101 and a first input terminal of a second thin film transistor 201, the other data control terminals 10 is respectively connected to first input terminals of the third and the fourth thin film transistors 301 and 401. A first switching control terminal 21 is respectively connected to the second input terminals of the first thin film transistor 101 and the fourth thin film transistor 401, and a second switching control terminal 22 is respectively connected to the first input terminals of the second thin film transistor 201 and the third thin film transistor 301. When the data control terminals 10 supplies data signals to the first thin film transistor 101 and the second thin film transistor 201 simultaneously, if the first switch control terminal 21 supplies an ON signal to the first thin film transistor 201, the first thin film transistor 201 will be turned on and supplies data signals to the data line M1; if the second switch control terminal 22 supplies an ON signal to the second thin film transistor 201, the second thin film transistor 201 will be turned on and supplies data signals to the data line M2. Accordingly, when the data control terminals 10 supplies data signals to the third thin film transistor 301 and the fourth thin film transistor 401 simultaneously, if the first switch control terminal 21 supplies an ON signal to the fourth thin film transistor 401, the fourth thin film transistor 401 will be turned on and supplies data signals to the data line M4; if the second switch control terminal 22 supplies an ON signal to the third thin film transistor 301, the third thin film transistor 301 will be turned on and supplies data signals to the data line M3. The data driving circuit according embodiments of the present disclosure comprises a plurality of driving units, each of the driving units supplies data signals to corresponding data lines in the manners described above.

It should be noted that, embodiments of the present disclosure is described by taking the switch units being thin film transistors as an example, and the thin film transistors each generally comprise a gate electrode, a source electrode and a drain electrode. The data control terminal in the embodiments of the present disclosure is connected to the source electrode of the thin film transistor (the first input terminal), the first switching control terminal or the second switching control terminal is connected to the gate electrode of the thin film transistor, then the drain electrode is an output terminal of the thin film transistor. Or, if the data control terminal is connected to the drain electrode of the thin film transistor (the first input terminal) and the first switching control terminal or the second switching control terminal is connected to the gate electrode of the thin film transistor (the second input terminal), then the source electrode is the output terminal of the thin film transistor.

At least one embodiment of the present disclosure provides a data driving circuit comprising a plurality of driving units, each of which comprises a first switch unit, a second switch unit, a third switch unit and a fourth switch unit, wherein each of the switch units comprises a first input terminal, a second input terminal and an output terminal; a first data control terminal and a second data control terminal, wherein the first data control terminal is respectively connected to the first input terminals of the first switch unit and the second switch unit, the second data control terminal is respectively connected to the first input terminals of the third switch unit and the fourth switch unit; a first switching control terminal, connected to the second input terminal of the first switch unit which is connected to the first data control terminal, and connected to the second input terminal of the third switch unit which is connected to the second data control terminal; a second switching control terminal, connected to the second input terminal of the second switch unit which is connected to the first data control terminal, and connected to the second input terminal of the fourth switch unit which is connected to the second data control terminal; the output terminal of each of the switch units being output terminals of the driving circuit, the output terminals of the two switch units connected to the same data control terminal can be respectively connected to the two data lines corresponding to one pixel subunit on the array substrate so as to supplies data signals to the data lines. When a data control terminal supplies data signals to the first input terminals of the two switch units connected to the data control terminal, if the first switching control terminal supplies an ON signal to the second input terminal of the switch unit connected to the first switching control terminal, the driving circuit supplies data signals to one of the data lines of one pixel subunit; if the second switching control terminal supplies an ON signal to the second input terminal of the switch unit connected to the second switching control terminal, the driving circuit supplies data signals to the other data line of the pixel subunit. Thus, one data control terminal can respectively supply data signals to two data lines and the number of data control terminals decreases, which helps to miniaturize the data driving IC and to reduce cost.

It should be noted that, the data driving circuit according an embodiment of the present disclosure can respectively supply data signals with opposite polarity or with the same polarity to the two data lines of one pixel subunit through one data control terminal.

Optionally, in one embodiment of the present disclosure, data signals output from the switch unit connected to the first switching control terminal and data signals output from the switch unit connected to the second switching control terminal have the same quantity of electrical charges with opposite polarities.

For example, as illustrated in FIG. 4, data signals output from the first thin film transistor 101 connected to the first switching control terminal 21 and data signals output form the second thin film transistor 210 connected to the second switching control terminal 22 have the same quantity of electrical charges with opposite polarities. Data signals output from the fourth thin film transistor 401 connected to the first switching control terminal 21 and data signals output from the third thin film transistor 301 connected to the second switching control terminal 22 have the same quantity of electrical charges with opposite polarities.

Optionally, in an embodiment, the second switch unit is adjacent to the third switch unit, and both the second switch unit and the third switch unit are connected to the first switching control terminal or the second switching control terminal. That is, as illustrated in FIG. 4, the second thin film transistor 201 is adjacent to the third thin film transistor 301, and both the second thin film transistor 201 and the third thin film transistor 301 are connected to the second switching control terminal 22. In this case, data signals output from the second thin film transistor 201 and the third thin film transistor 301 have the same quantity of electrical charges with the same polarity. Of course, both the second thin film transistor 201 and the third thin film transistor 301 can also be connected to the first switching control terminal 21. Embodiments of the present disclosure are explained in detail by taking what is illustrated in the figures as an example.

Figure 5:
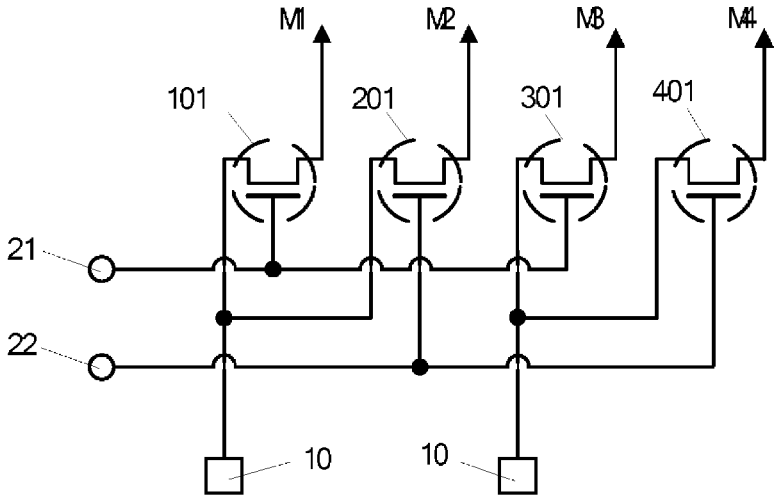
FIG. 5 is a schematic view of another data driving circuit according to an embodiment of the present disclosure.

Optionally, in one embodiment, the second switch unit is adjacent to the third switch unit, and both the second switch unit and the third switch unit are respectively connected to the first switching control terminal and the second switching control terminal. That is, as illustrated in FIG. 5, the second thin film transistor 201 is adjacent to the third thin film transistor 301, and both the second thin film transistor 201 and the third thin film transistor 301 are respectively connected to the first switching control terminal 21 and the second switching control terminal 22. In this case, data signals output from the second thin film transistor 201 and data signals output from the third thin film transistor 301 have opposite polarities. For example, as illustrated in FIG. 5, the second thin film transistor 201 is connected to the second switching control terminal 22 and the third thin film transistor 301 is connected to the first switching control terminal 21. Of course, the second thin film transistor 201 can also be connected to the first switching control terminal 21, and the third thin film transistor 301 is connected to the second switching control terminal 22. And then, the first thin film transistor 101 is connected to the second switching control terminal 22 and the fourth thin film transistor 401 is connected to the first switching control terminal 21.

At least one embodiment of the present disclosure provides a display device, which comprises an array substrate and a data driving circuit as described in any embodiment of the present disclosure, a plurality of gate lines and a plurality of data lines intersecting with each other on the array substrate to define a plurality of pixel subunit, wherein one pixel subunit corresponds to one gate line and two data lines, output terminals of four switch units of the data driving circuit correspond to four data lines of two pixel units adjacent to each other on the array substrate, output terminals of two switch units connected to the same data control terminal are respectively connected to the two data lines of one pixel subunits on the array substrate, so as to supply data signals to the data lines.

It should be noted that, in the embodiment of the present disclosure, output terminals of the two switch units controlled by the same data control terminal are respectively connected to the two data lines of one pixel subunit on the array substrate, so as to supply data signals to the data lines, that is, a pixel subunit on the array substrate supplies voltage signals to pixel electrode of the same pixel unit through two data lines. The array substrate can be an array substrate used for forming a liquid display device of TFS mode.

Figure 8:
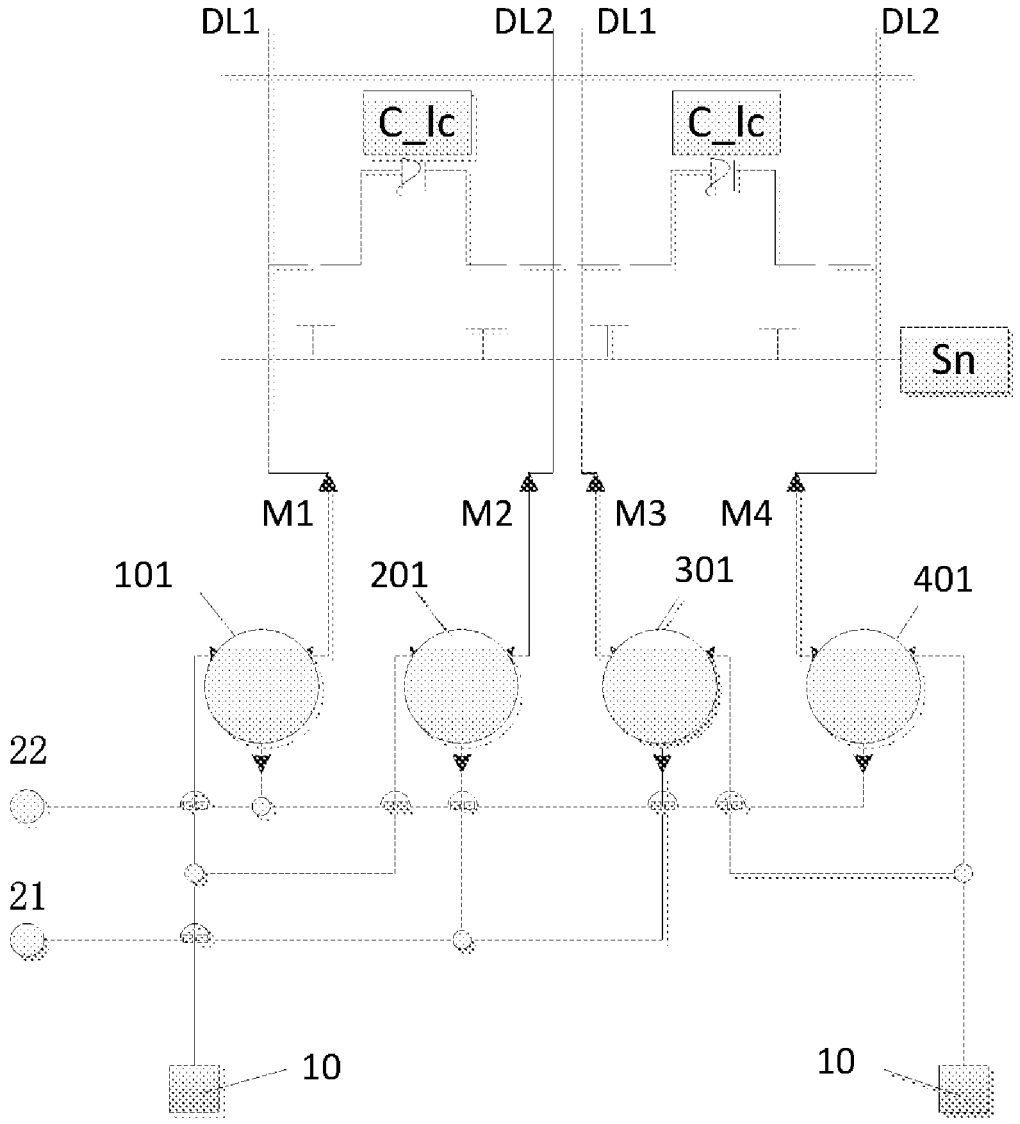
FIG. 8 a schematic view illustrating the connection relationship of the pixel unit with the data driving circuit according to an embodiment of the present disclosure.

For example, as illustrated in FIG. 8, one data control terminal 10 of the data driving circuit respectively controls two output terminals (taking M1 and M2 as examples), the two output terminals are respectively connected to the two data lines (DL1, DL2) of one pixel subunit (Clc) on the array substrate. When the data control terminal 10 supplies data signals to the first input terminal of the switch unit (101, 201), if the first switching control terminal 21 supplies an ON signal to the second input terminal of the first switch unit 101, the driving circuit can supply data signals to one of the data lines (DL1) of one pixel subunit; and if the second switching control terminal 22 supplies an ON signal to the second input terminal of the second switch unit 201, the driving circuit can supply data signals with opposite polarity to the other data line of the pixel subunit (DL2). Thus, data signals can be supplied to the two data lines (DL1, DL2) through one data control terminal 10, which decreases the amount of the data control terminals, helps to miniaturize the data driving IC and reduces the cost.

Optionally, in one embodiment, the display device further comprises: a timing controller, which supplies polarity control signal for the data signals to the data driving circuit.

It should be noted that, the timing controller is a core device for driving the liquid crystal display panel, and mainly functions to supply necessary timing control signal to the gate driver and source driver in the thin film transistor-liquid crystal display. The timing controller receives low voltage differential signaling (LVDS) from the front stage and converts the received LVDS into MINI-LVDS signals, and outputs corresponding timing control signals to drive the liquid crystal display panel, so as to drive each pixel to display a corresponding pixel voltage. The timing controller outputs four main control signals, namely STV, CPV, TP and POL, wherein the POL signal is a polarity reversing signal for controlling voltage of the pixel, that is, polarity reversing signals can be supplied to the data driving IC by the timing controller in the embodiments of the present disclosure, so that data signals with opposite polarities are supplied to the data lines via the first switching control terminal and the second switching control terminal.

At least one embodiment of the present disclosure provides a driving method for the display device described above, comprising:

Supplying driving signals by a data control terminal to switch units connected to the data control terminal during a scanning period;

Supplying an ON signal by a first switching control terminal to the switch unit connected to the first switching control terminal, so that an output terminal of the switch unit supplies data signals to a data line connected to the switch unit;

Supplying an ON signal by a second switching control terminal to the switch unit connected to the second switching control terminal, so that an output terminal of the switch unit supplies data signals to a data line connected to the switch unit.

It should be noted that, the first switching control terminal and the second switching control terminal can simultaneously supply ON signals to the switch units connected thereto, so that the output terminals of the switch unit supply data signals to the data lines connected thereto; and the first switching control terminal and the second switching control terminal can respectively supply ON signals to the corresponding switch unit connected thereto during different periods, so that the output terminals of the switch units supply the data signals to the data lines connected thereto.

Figure 6:
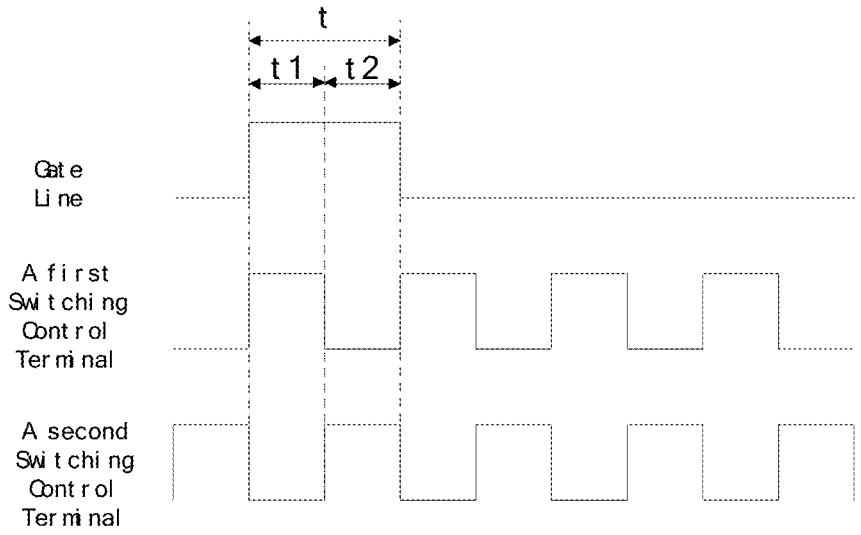
FIG. 6 is a schematic view of a driving method for an array substrate according to an embodiment of the present disclosure.

The schematic view of the driving signals of the data driving circuit, as illustrated in FIG. 6, illustrates that the first switching control terminal and the second switching control terminal of the driving circuit as illustrated in FIG. 4 simultaneously supplies an ON signal to the switch units connected thereto during a scanning period. For example, referring to FIG. 4, during the scanning period t, the data control terminal 10 supplies an ON signal to the first thin film transistor 101 and the second thin film transistor 201 connected thereto. And then, during the first scanning sub-period t1, the first switching control terminal 21 supplies an ON signal to the first thin film transistor 101 and the first thin film transistor outputs corresponding data signals to M1. During the second scanning sub-period t2, the second switching control terminal 22 supplies an ON signal to the second thin film transistor 201 and the second thin film transistor outputs corresponding data signals to M2. It should be noted that, in the FIG. 6, the first switching control terminal and the second switching control terminal output a high level signal as an ON signal.

It should be noted that, during the scanning period t, the data control terminal 10 supplies an ON signal to the third thin film transistor and the fourth thin film transistor connected thereto, and the present disclosure is described in detail by taking the above as an example.

Figure 7:
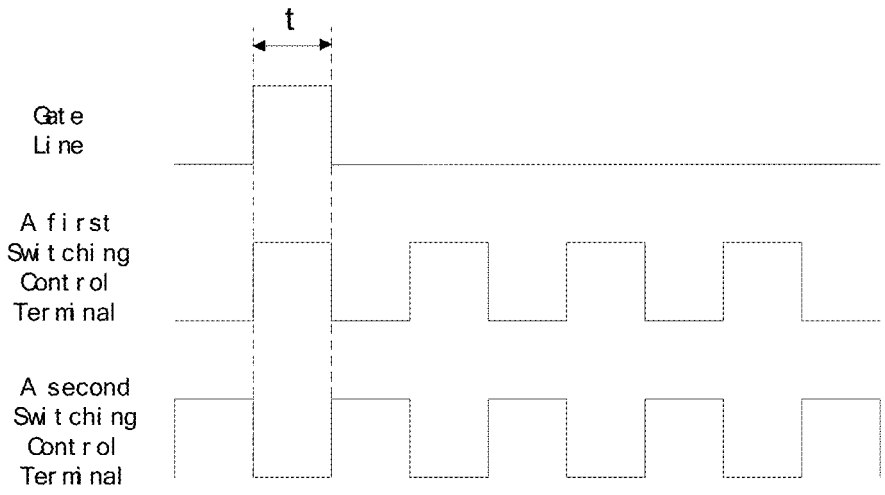
FIG. 7 is a schematic view of another driving method for an array substrate according to an embodiment of the present disclosure.

The schematic view of the driving signals of the data driving circuit, as illustrated in FIG. 7, illustrates that the first switching control terminal and the second switching control terminal of the driving circuit as illustrated in FIG. 4 respectively supplies an ON signal to the switch units connected thereto during the same scanning period. During the scanning period t, the data control terminal 10 supplies driving signals to the first thin film transistor 101 and the second thin film transistor 201 connected thereto. During the scanning period t, the first switching control terminal supplies ON signals, and then the first thin film transistor 101 connected to the first switching control terminal 21 is turned on, and outputs corresponding data signals to M1. During the scanning period t, the second switching control terminal supplies an ON signal, and then the second thin film transistor 201 connected to the second switching control terminal 22 is turned on, and outputs corresponding data signals to M2. FIG. 7 is described in detail by taking the first switching control terminal supplying a high level signal and the second switching control terminal supplying a low level signal as an example.

It should be noted that, during the scanning period t, the data control terminal 10 can also supply ON signals to the third thin film transistor and the fourth thin film transistor, the present disclosure is explained in detail by what is described above as an example. The first switching control terminal and the second switching control terminal simultaneously supplying ON signals can avoid display defects due to delay of signals.

Optionally, in one embodiment, the ON signal supplied by the first switching control terminal and the ON signal supplied by the second switching control terminal have the same quantity of electrical charges with opposite polarities, so that data signals output from the switch unit connected to the first switching control terminal and the data signals output from the switch unit connected to the second switching control terminal have the same quantity of electrical charges with opposite polarities.

That is, as illustrated in FIG. 4, data signals output from the first thin film transistor 101 connected to the first switching control terminal 21 and data signals output form the second thin film transistor 201 connected to the second switching control terminal 22 have the same quantity of electrical charges with opposite polarities.

Optionally, in one embodiment, polarity control signals for data signals can be supplied to the data driving circuit via the timing controller. The timing controller controlling polarities of the data signals supplied by the data driving circuit can refer to conventional control by the timing controller on the data driving circuit, which will not be described repeatedly.

The foregoing are merely exemplary embodiments of the invention, but are not used to limit the protection scope of the invention. The protection scope of the invention shall be defined by the attached claims.

The present disclosure claims priority of Chinese Patent Application No. 201410041066.5 filed on Jan. 27, 2014, the disclosure of which is hereby entirely incorporated by reference.

The invention claimed is:

1. A data driving circuit, comprising a plurality of driving units, wherein each of the plurality of driving units comprises:

a first switch unit, a second switch unit, a third switch unit, and a fourth switch unit, wherein each of the switch units comprises a first input terminal, a second input terminal, and an output terminal;

a first data control terminal and a second data control terminal, wherein the first data control terminal is connected to the first input terminal of the first switch unit and the first input terminal of the second switch unit; the second data control terminal is connected to the first input terminal of the third switch unit and the first input terminal of the fourth switch unit;

a first switching control terminal, connected to the second input terminal of one of the switch units connected to a same data control terminal; and a second switching control terminal, connected to the second input terminal of the other of the switch units connected to the same data control terminal, wherein the output terminals of the switch units are output terminals of the data driving circuit, and wherein during a scanning period, each of the first switching control terminal and the second switching control terminal simultaneously supplies a respective ON signal, the ON signal supplied by the first switching control terminal and the ON signal supplied by the second switching control terminal have a same quantity of electrical charges with opposite polarities, and the one of the switch units connected to the first switching control terminal and the other of the switch units connected to the second switching control terminal are simultaneously turned on, and data signals output from the one of the switch units connected to the first switching control terminal and data signals output from the other of the switch units connected to the second switching control terminal have a same quantity of electrical charges with opposite polarities.

2. The data driving circuit according to claim 1, wherein each of the first switch unit, the second switch unit, the third switch unit, and the fourth switch unit is a thin film transistor.

3. The data driving circuit according to claim 2, wherein the second switch unit is adjacent to the third switch unit and both of the second switch unit and the third switch unit are connected to the first switching control terminal or the second switching control terminal.

4. A display device comprising an array substrate and the data driving circuit according to claim 2, a plurality of gate lines and a plurality of data lines intersecting with each other being disposed on the array substrate to define a plurality of pixel subunits, wherein one pixel subunit corresponds to one gate line and two data lines; four switch units of the data driving circuit are respectively connected to four data lines of two pixel units adjacent to each other on the array substrate; and output terminals of two switch units connected to a same data control terminal are respectively connected to two data lines of one pixel subunit on the array substrate so as to supply data signals to the data lines.

5. The data driving circuit according to claim 1, wherein the second switch unit is adjacent to the third switch unit, and both of the second switch unit and the third switch unit are connected to the first switching control terminal or the second switching control terminal.

6. A display device comprising an array substrate and the data driving circuit according to claim 5, a plurality of gate lines and a plurality of data lines intersecting with each other being disposed on the array substrate to define a plurality of pixel subunits, wherein one pixel subunit corresponds to one gate line and two data lines; four switch units of the data driving circuit are respectively connected to four data lines of two pixel units adjacent to each other on the array substrate; and output terminals of two switch units connected to a same data control terminal are respectively connected to two data lines of one pixel subunit on the array substrate so as to supply data signals to the data lines.

7. The data driving circuit according to claim 1, wherein the second switch unit is adjacent to the third switch unit, and the second switch unit and the third switch unit are respectively connected to the first switching control terminal and the second switching control terminal.

8. A display device comprising an array substrate and the data driving circuit according to claim 7, a plurality of gate lines and a plurality of data lines intersecting with each other being disposed on the array substrate to define a plurality of pixel subunits, wherein one pixel subunit corresponds to one gate line and two data lines; four switch units of the data driving circuit are respectively connected to four data lines of two pixel units adjacent to each other on the array substrate; and output terminals of two switch units connected to a same data control terminal are respectively connected to two data lines of one pixel subunit on the array substrate so as to supply data signals to the data lines.

9. A display device comprising an array substrate and the data driving circuit according to claim 1, a plurality of gate lines and a plurality of data lines intersecting with each other being disposed on the array substrate to define a plurality of pixel subunits, wherein one pixel subunit corresponds to one gate line and two data lines; the four switch units of the data driving circuit are respectively connected to four data lines of two pixel units adjacent to each other on the array substrate; and output terminals of two switch units connected to a same data control terminal are respectively connected to two data lines of one pixel subunit on the array substrate so as to supply data signals to the data lines.

10. The display device according to claim 9, further comprising a timing controller which supplies polarity control signal for data signals to the data driving circuit.

11. The data driving circuit according to claim 1, wherein the second switch unit is adjacent to the third switch unit and both of the second switch unit and the third switch unit are connected to the first switching control terminal or the second switching control terminal.

12. A method for driving a display device, the display device comprising an array substrate and a data driving circuit, a plurality of gate lines and a plurality of data lines intersecting with each other being disposed on the array substrate to define a plurality of pixel subunits, the data driving circuit comprising a plurality of driving units, wherein each of the driving units comprises:

a first switch unit, a second switch unit, a third switch unit and a fourth switch unit, wherein each of the switch units comprises a first input terminal, a second input terminal and an output terminal, respectively;

a first data control terminal and a second data control terminal, wherein the first data control terminal is connected to the first input terminal of the first switch unit and the first input terminal of the second switch unit, respectively; the second data control terminal is connected to the first input terminal of the third switch unit and the first input terminal of the fourth switch unit, respectively;

a first switching control terminal, connected to the second input terminal of one of the switch units connected to a same data control terminal; and a second switching control terminal, connected to the second input terminal of the other of the switch units connected to the same data control terminal, wherein the output terminals of the switch units are output terminals of the data driving circuit, and wherein one pixel subunit corresponds to one gate line and two data lines; four switch units of the data driving circuit are respectively connected to four data lines of two pixel units adjacent to each other on the array substrate, and the output terminals of two switch units connected to a same data control terminal are respectively connected to two data lines of one pixel subunit on the array substrate so as to supply data signals to the data lines;

the method comprising:

supplying driving signals by the first and the second data control terminals to respective switch units connected with the first and the second data control terminals;

during a scanning period, supplying an ON signal by the first switching control terminal to the switch unit connected with the first switching control terminal, so that an output terminal of the switch unit supplies data signals to a data line connected with the output terminal; and during the scanning period, simultaneously to the supplying the ON signal by the first switching control terminal, supplying an ON signal by the second switching control terminal to the switch unit connected with the second switching control terminal, so that an output terminal of the switch unit supplies data signals to the respective data lines connected with the output terminals, wherein, during the scanning period, the ON signal supplied by the first switching control terminal and the ON signal supplied by the second switching control terminal have a same quantity of electrical charges with opposite polarities, the switch unit connected with the first switching control terminal and the switch unit connected with the second switching control terminal are simultaneously turned on, and data signals output from the switch unit connected with the first switching control terminal and data signals output from the switch unit connected with the second switching control terminal have a same quantity of electrical charges with opposite polarities.

13. The method according to claim 12, wherein a timing controller supplies polarity control signals for the data signals to the data driving circuit.

* * * * *